US006615927B1

(12) United States Patent
Kim

(10) Patent No.: US 6,615,927 B1
(45) Date of Patent: Sep. 9, 2003

(54) AUTOMATIC SPRINKLER OF FIRE DETECTOR TYPE AND SPRINKLER SYSTEM INCLUDING THE SPRINKLER

(76) Inventor: Sang Wook Kim, SSANG Ryong Apartment 7-706, Daechi-dong, Gangnam-Gu, Seoul 1360280 (KR)

( * ) Notice: Subject to any disclaimer, the term of this patent is extended or adjusted under 35 U.S.C. 154(b) by 0 days.

(21) Appl. No.: 09/654,602

(22) Filed: Sep. 1, 2000

(30) Foreign Application Priority Data

Feb. 8, 2000 (KR) ..... 2000-05694
Aug. 7, 2000 (KR) ..... 2000-45604

(51) Int. Cl.[7] ..... A62C 37/08
(52) U.S. Cl. ..... 169/37; 169/42
(58) Field of Search ..... 169/16, 17, 19, 169/37, 38, 39, 42, DIG. 3

(56) References Cited

U.S. PATENT DOCUMENTS 3,863,720 A * 2/1975 Young ..... 169/37
4,893,679 A * 1/1990 Martin et al. ..... 169/42
5,927,406 A * 7/1999 Kadoche ..... 169/17

* cited by examiner

*Primary Examiner*—Lisa A. Douglas
(74) *Attorney, Agent, or Firm*—Schmeiser, Olsen & Watts LLP

(57) ABSTRACT

An automatic sprinkler of fire detector type being electrically switchable when the sprinkler is opened due to detachment of heat actuatable element from the sprinkler is provided, and, thus, fire-protective signaling and controlling system associated with a sprinkler system including the automatic sprinkler of fire detector type can be activated by electrical switching of the automatic sprinkler of fire detector type when fire occurs. And, in a sprinkler system having non-wet piping network and normally closed deluge valve, it is possible that opening of the deluge valve can be made by electrical switching of the automatic sprinkler of fire detector type.

22 Claims, 15 Drawing Sheets

AUTOMATIC SPRINKLER OF FIRE DETECTOR TYPE AND SPRINKLER SYSTEM INCLUDING THE SPRINKLER

BACKGROUND OF THE INVENTION

1. Field of the Invention

The present invention is related to an automatic sprinkler of fire detector type and sprinkler system including the automatic sprinkler of fire detector type.

In particular, this invention is related to an automatic sprinkler of fire detector type that has not only its inherent function to make opening by itself when a fire occurs, but also a function of electric switch similar to an ordinary fixed-temperature fire detector, and the sprinkler system that includes the automatic sprinkler of fire detector type. More particularly, the above sprinkler system can detect a fire in a freely established area with one or more sprinklers where sprinkler opens.

2. Description of the Prior Art

In general, two types are found in sprinklers; one is closed-type sprinkler and the other is open-type sprinkler.

The closed-type sprinkler includes a heat-actuated element in itself that normally seals a water discharge orifice and is separated by itself from the sprinkler by heat from a fire, and so the closed-type sprinkler is called 'automatic sprinkler' in most literatures of fire protection.

There are various kinds of existing automatic sprinkler, but two operating modes may be found in all automatic sprinklers; one sprinkler can not re-close by itself once opened by heat, but the other sprinkler to be usually called 'on-off sprinkler' can automatically repeat opening and closing in turn by a rise or drop in ambient temperature in the course of fire control.

The automatic sprinkler of non-reclosable type has a heat-actuated element to be fusible or frangible by heat. The fusible heat-actuated element that holds a small quantity of metal to be fusible at a predetermined temperature normally seals a water discharge orifice of sprinkler and then the water discharge orifice is opened when the fusible heat-actuated element is separated from the sprinkler due to melting of the metal by heat. The frangible heat-actuated element that holds a glass bulb containing some liquid of good thermal expansion property normally seals a water discharge orifice of sprinkler and then the water discharge orifice is immediately opened when the bulb is broken by the expanding pressure of liquid generated in the bulb at a predetermined temperature. Typical on-off sprinkler usually has two thermal elements; one is a frangible bulb to initially open the sprinkler orifice and the other is a pilot valve leading to the repeat of opening and closing of a water discharge outlet according to actuation of bimetallic disc by a rise or drop in ambient temperature in the course of fire control. The opening of pilot valve allows water to flow from the sprinkler. When the sprinkler discharge suppresses the fire so the temperature of bimetallic disc drops, the pilot valve is closed and then the waterflow stops.

FIG. 1 shows an outlined drawing of an exemplification of existing automatic sprinkler. And FIG. 2 is a drawing to show that the sprinkler in FIG. 1 opens with separation of fusible heat-actuated element. Such a sort of sprinkler(11), which has been used for a long time, is composed of three essential parts, one of which is a heat-actuated element(17) to be fusible that normally seals a water discharge orifice (13), another is a metallic framed-body(12) with a water discharge orifice(13) and the other is a deflector(15) for dispersion of water discharged out of the water discharge orifice(13) on the other side of water discharge orifice(13). The fusible heat-actuated element(17) tightly seals the water discharge orifice(13) by driving a screw(16) in the center of deflector(15). The fusible heat-actuated element(17) is shaped by assembling several components, one of which is the fusible metal to be previously mentioned, not shown in the drawing, is included. The separation of fusible heat-actuated element(17) from the sprinkler is occurred simultaneously with disassembly of the fusible heat-actuated element(17) since mechanical balance built up among the components of fusible heat-actuated element(17) is lost when the fusible metal held in the fusible heat-actuated element(17) is melted by heat. And the automatic sprinkler of framed-body type is the most commonly used in many countries in the world. The metallic framed-body may have two or more frames(14). An orifice-sealing disc(18) and a disc-supporting metal(19) of round type can be positioned between the water discharge orifice(13) and the fusible heat-actuated element(17).

However, any of all existing automatic sprinklers does not have a mechanism in itself to directly actuate electric circuit that may be introduced for supervisions of sprinkler system such as fire detection, fire indication and fire alert, etc. as shown in ordinary fire detection systems, and so supplemental fire detection system or means for detecting a waterflow to be initiated by discharge of water or air (or nitrogen) from opened sprinkler has been utilized over years for detection of a fire in sprinklered area.

The wet pipe sprinkler system in FIG. 3, the dry pipe sprinkler system in FIG. 4 and the preaction sprinkler system in FIG. 5 are the most typically and widely used among the various existing automatic sprinkler systems.

In the automatic sprinkler systems, one or more water supplies, system pipings and automatic sprinklers are the essential requirements, however, there are various differences between them in system design feature and functional aspect. And, fire water may be obtained from a public or private water source, and in a water supply with a private source, water tank or pond is usually required while associated with fire pump. Such a water tank connected to fire pump as shown in the drawings is primarily necessitated, but an auxiliary tank such as an elevated tank may be included as a supplementary water source. There are various design features in configuration of water supply for sprinkler system, being influenced by infrastructures and circumstances given to a sprinklered building or structure, however, a primary water tank associated with a fire pump and a pressure maintenance pump, and a supplementary elevated tank(23) are examplified for water supply to the sprinkler systems shown in FIGS. 3, 4 and 5. The pressure maintenance pump is employed to make up water pressure in system pipings since a pressure drop in the system pipings to be initiated by water discharge from opened sprinkler can be utilized for automatic operation of the fire pump. In this case, pressure switches are usually used to detect the pressure drop or rise for starting or stopping the fire pump and the pressure maintenance pump.

In such the wet pipe sprinkler system as shown in FIG. 3, all pipings(21) always contain water and are connected to water supply so that water discharges immediately from the sprinklers(11) opened by heat from a fire. The wet pipe sprinkler system is the simplest and the most reliable of all the sprinkler systems, but it is undesirable to employ this system in the sprinklered area to be subject to water freezing.

In the wet pipe sprinkler system, a waterflow detecting device(31) to be called 'alarm check valve' is the most commonly employed on a system riser pipe(54) to detect opening of sprinkler(11), that is, the opening of sprinkler lets water discharge into the fire area and in turn the water flowing to the opened area through the system riser pipe activate the waterflow detecting device(31).

And, a test-connection(26) examplified in FIGS. 3 and 4 is usually installed to routinely test the performance of waterflow detecting device.

As shown in FIG. 4, the dry pipe sprinkler system developed to meet the need for sprinkler protection in unheated occupancies or structures has a dry pipe valve(25) on a system riser pipe(54), and all system pipings(21) above the dry pipe valve(25) do not contain water but air or nitrogen under pressure. The air or nitrogen pressure restrains the water in the water supply main at the clapper arrangement (not shown in the drawing) of the dry pipe valve(25), and the release of pressurized air or nitrogen, which is initiated prior to discharge from the opened sprinkler(11), permits the water pressure in the water supply main to open the dry pipe valve(25). The water then flows into the system pipings(21) above the dry pipe valve(25) and out of the opened sprinkler(11). The dry pipe valve(25) also has a waterflow detecting function similar to the alarm check valve to be employed in the wet pipe sprinkler system. An air compressor(27) should be employed to make up air pressure in system pipings.

As shown in FIG. 5, the preaction sprinkler system employs a deluge valve(32) on a system riser pipe(54) that is normally closed in non-fire situation, and the automatic sprinklers(11) attached to the system pipings(21) containing air that may or may not be under pressure, together with supplemental fire detection systems(34) including fire detectors(33) which are installed in the same area as the sprinklers(11) for operation of deluge valve(32).

Actuation of the fire detection system(34) opens the deluge valve(32) that permits water to flow into the system pipings(21) and be discharged from any sprinklers(11) that are open. The deluge valve(32) may or may not have a waterflow detecting function, relying on design feature of system(34) and arrangement of trimmings to be associated with the deluge valve(32).

The water supply including water tank(22) and fire pump (24) is widely introduced in many sprinkler systems, and in this case, it is usual to provide automatization in operation of fire pump(24).

Automatic operation of fire pump(24) in sprinkler systems may be possible by means of detection of a waterflow in system pipings(21) or a drop in water pressure in system pipings(21) that is caused by water discharge due to opening of sprinkler(11), however, automatic operation of fire pump (24) in the preaction sprinkler system may be initiated by actuation of fire detection system(34) accompanied with the preaction sprinkler system, but this is not frequent on account of a real frequency in false operation or malfunction of customary fire detectors(33).

It is usual that supervisions such as fire detection, fire indication and fire alerts, etc. to be needed in wet pipe sprinkler system or dry pipe sprinkler system, though control for operation of fire pump(24) is occasionally included, are initiated by activation of waterflow detecting device(31), and in preaction sprinkler system, by actuation of fire detection system(34) or activation of waterflow detecting device(31) or both. However, in many sprinkler systems, automatic operation of fire pump(24) is initiated by actuation of pressure switch(30) that detects a drop or rise in water pressure in system pipings(21) to be generated when water discharges from opened sprinkler, and in this case, pressure maintenance pump(28) may be quite often employed to pressurize water in system pipings(21).

It is noted that a waterflow detecting device(31) or other device with waterflow detecting function can not addressably detect opening of every sprinkler, neither can it detect opening of sprinkler in every area to be freely established and protected by two or more sprinklers. In other words, the above device can not addressably detect every area to be freely established and protected by one or more sprinklers. Therefore, if trying to make such an addressable fire detection to be possible, a waterflow detecting device(31) or a fire detector(33) of addressable type should be individually joined with every sprinkler or every area to be freely established, but it might not be practical on account of a demand of much money as well as more complicated systemization.

SUMMARY OF THE INVENTION

The first object of the present invention is to provide an automatic sprinkler having both a function of fire detector similar to a fixed-temperature fire detector that the existing automatic sprinkler does not have and its inherent function of automatic opening for water discharge.

The second object of the present invention is to provide a sprinkler system that can make addressable supervisions such as addressable fire detection, fire indication and alert of fire, etc. to be initiated by actuation of automatic sprinkler of fire detector type installed in sprinkler system.

The third object of the present invention is to provide a sprinkler system that can make operating equipments or devices such as fire pumps and fire alarm initiating devices to automatically operate by actuation of automatic sprinkler of fire detector type without any pressure maintenance pump and pressure switch.

The fourth object of the present invention is to provide a sprinkler system of intelligent type that may discharge water into a fire area with application density to be adjustable that can be obtained by RPM adjustment of a fire pump with a speed-changeable driving-motor that is controlled by a computer to be hydraulically pre-programmed according to the number of opened sprinklers in the fire area.

The fifth object of the present invention is to provide a sprinkler system that can satisfactorily detect a fire even with no waterflow detecting device.

The sixth object of the present invention is to provide a simple sprinkler system that is available for protection of unheated sprinklered area; in the above sprinkler system a deluge valve that can be opened by actuation of automatic sprinkler of fire detector type is employed on a system riser pipe, and the opening of the deluge valve can allow water to flow into system pipings that are always maintained empty without air-pressurization, and then the water is discharged from opened sprinkler.

The seventh object of the present invention is to provide a sprinkler system more reliable than all existing sprinkler systems, in a point of view that operation of the sprinkler system in accordance with the present invention is initiated by the opening of automatic sprinkler of fire detector type that is rarely occurred accidentally in non-fire situation when compared with real frequency of accidental activation or malfunction of ordinary fire detector or waterflow detecting device in non-fire situation.

A further object of the present invention is to provide a sprinkler system that can take care and maintenance to be more convenient and economical than the existing automatic sprinkler systems.

It is to be noted that both the foregoing general description and the following description in detail are exemplary and explanatory and are intended to provide further explanation of the invention as claimed.

BRIEF DESCRIPTION OF THE DRAWINGS

The objects, features and advantages of the present invention will come out more apparently in accordance with the preferred embodiments thereof with reference to the accompanying drawings, in which.

DETAILED DESCRIPTION OF THE PREFERRED EMBODIMENTS

The existing automatic sprinkler to be the most widely used basically consists of a metallic framed-body(12) with a water discharge orifice(13), a deflector(15) for dispersion of water discharged from the water discharge orifice(13) and a heat-actuated element(17) that normally seals the water discharge orifice(13), positioning between the water discharge orifice(13) and the deflector(15), and is separated from the sprinkler by heat. The above automatic sprinkler (11) has been used for extinguishment or control of a fire with only mechanical functions such as sealing of the water discharge orifice(13), actuation and separation of heat-actuated element(17), water discharge, and dispersion of water.

However, as shown in FIG. 6 to FIG. 13, an automatic sprinkler of fire detector type in accordance with the present invention has a function of electric switch as well as the mechanical functions to be described above.

The above function of electric switch that the existing automatic sprinkler does not have can permit a couple of positive and negative poles joined to the above automatic sprinkler of fire detector type to be connected or disconnected to each other due to separation of heat-actuated element, and hence automatic sprinkler of fire detector type in accordance with the present invention can be characterized. In other words, the above electric function of automatic sprinkler of fire detector type in accordance with the present invention is essentially not different from an ordinary fixed-temperature fire detector that operates at a pre-determined temperature.

Provision of the above function of electric switch may be directly related to how to configure an electric switch that is normally open or close and can activate in accordance with separation of heat-actuated element(17).

Figure 1:
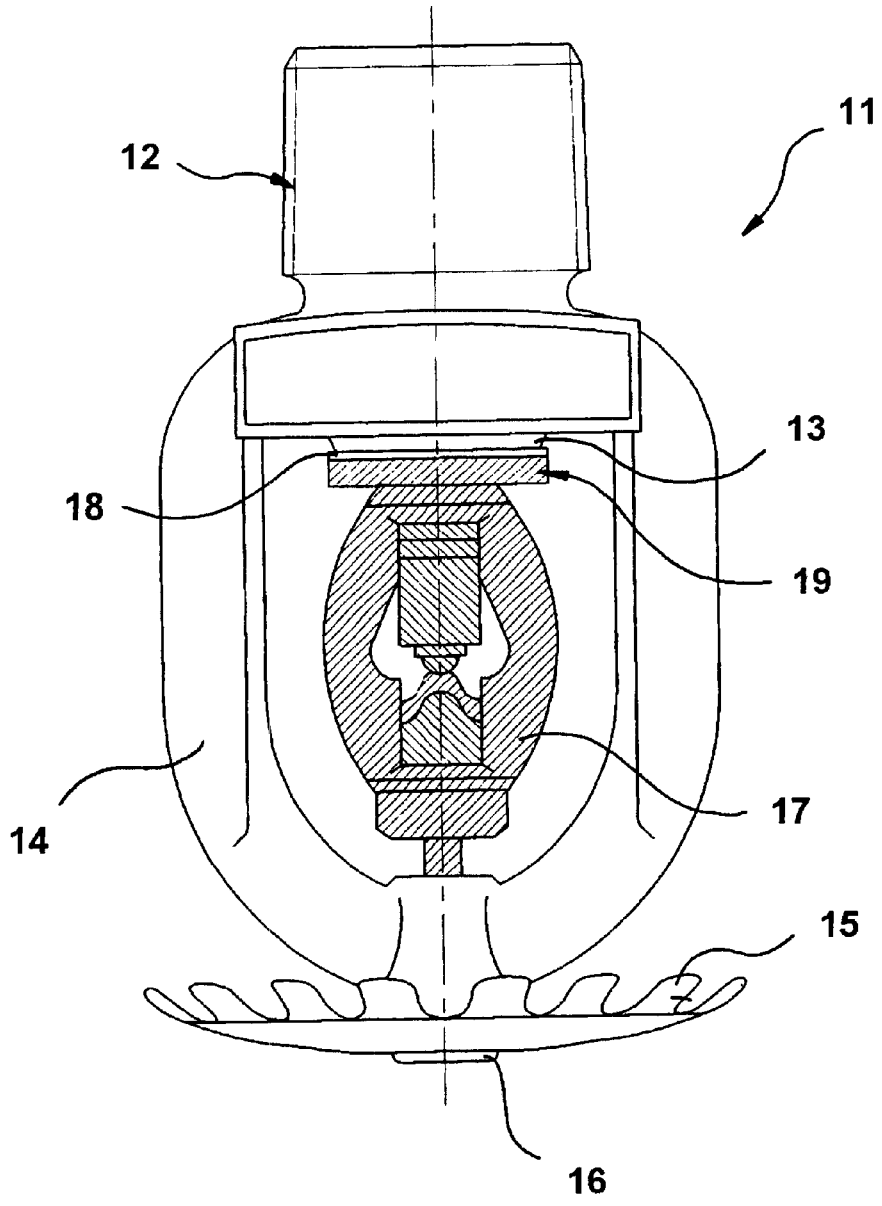
FIG. 1 is an outlined drawing to show one of the existing automatic sprinkler with a metallic framed-body and a heat-actuated element to be fusible.
Figure 2:
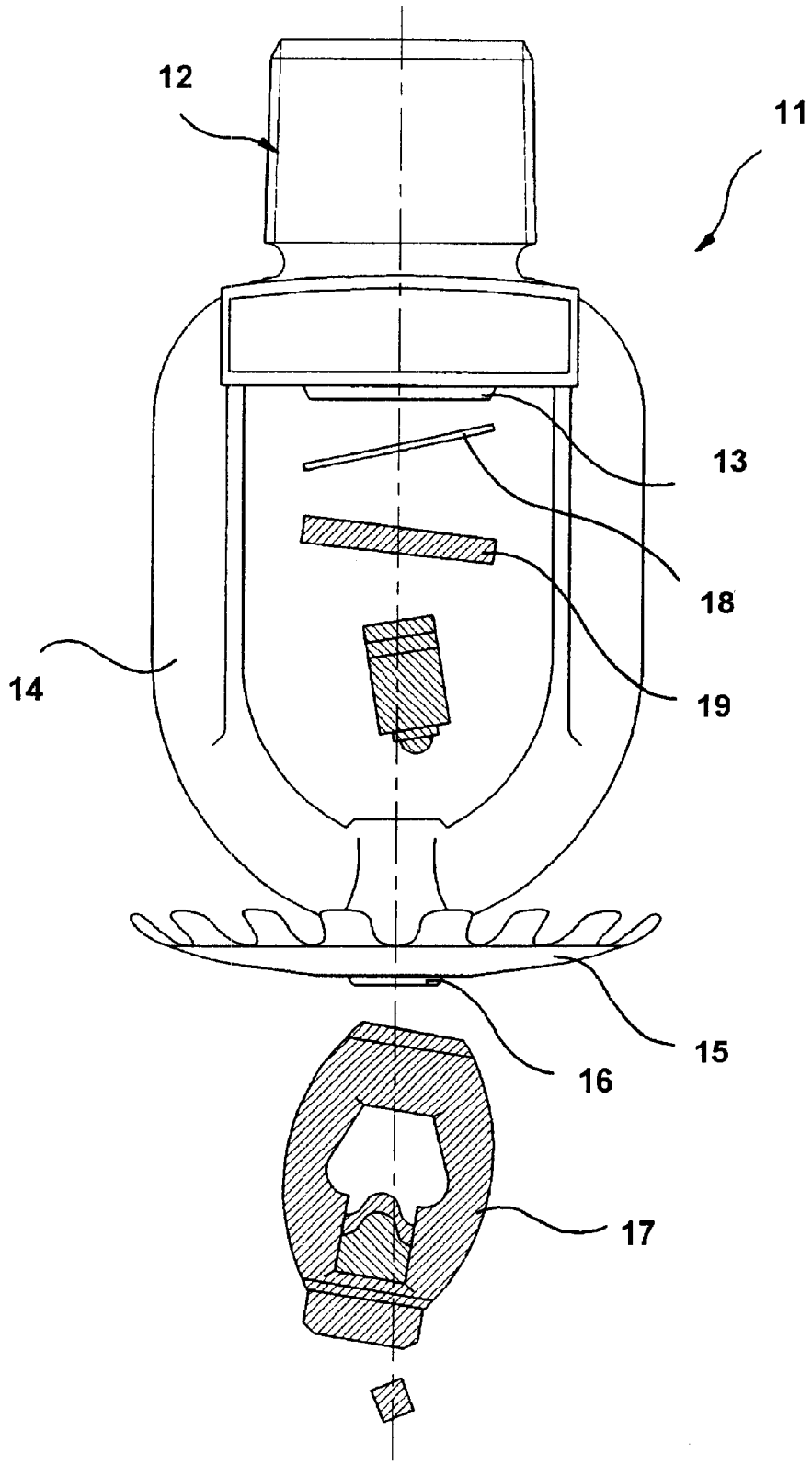
FIG. 2 is a drawing to show that the sprinkler in FIG. 1 opens with separation of fusible element.
Figure 3:
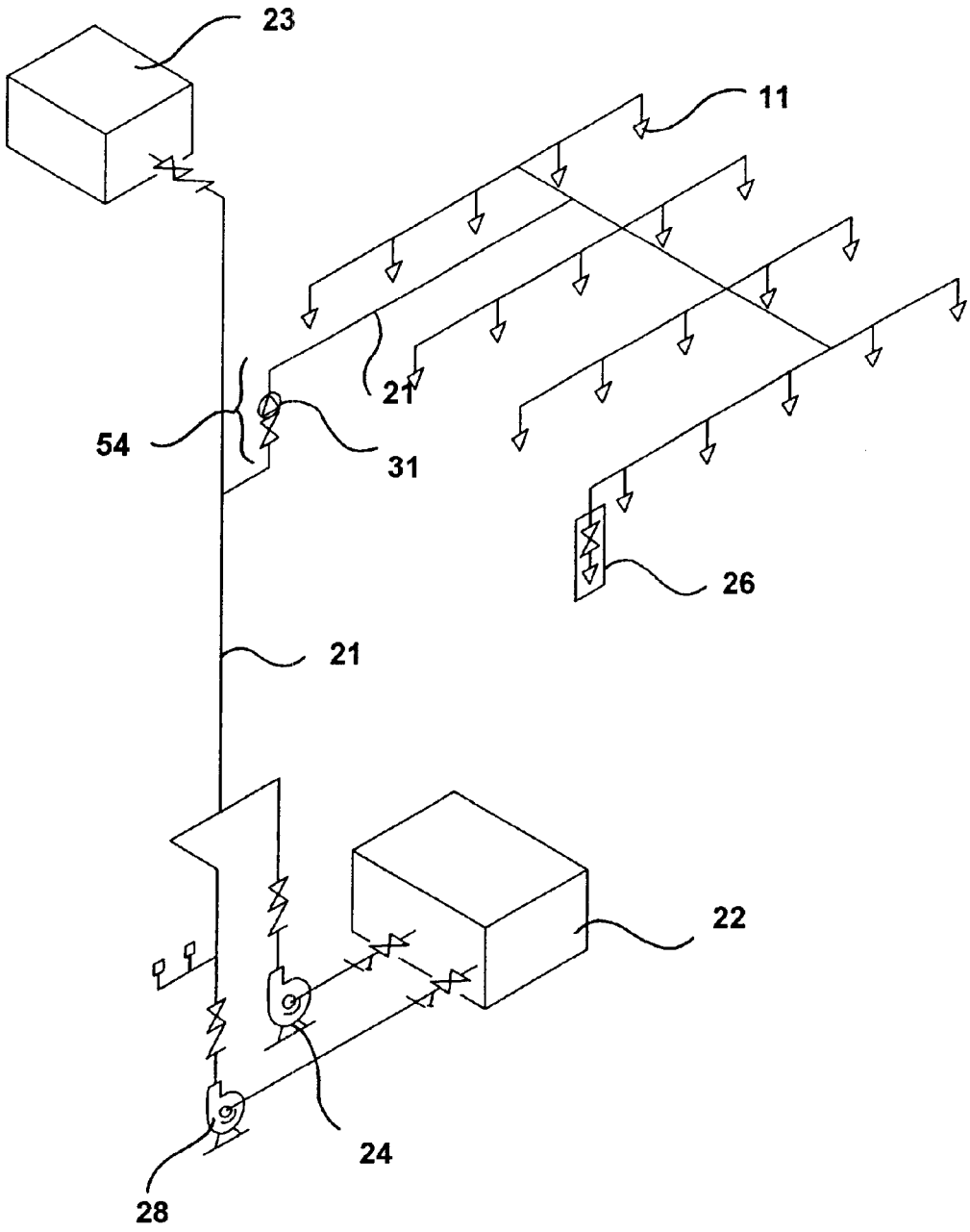
FIG. 3 is an outlined diagram to show an exemplification of wet pipe sprinkler system.
Figure 4:
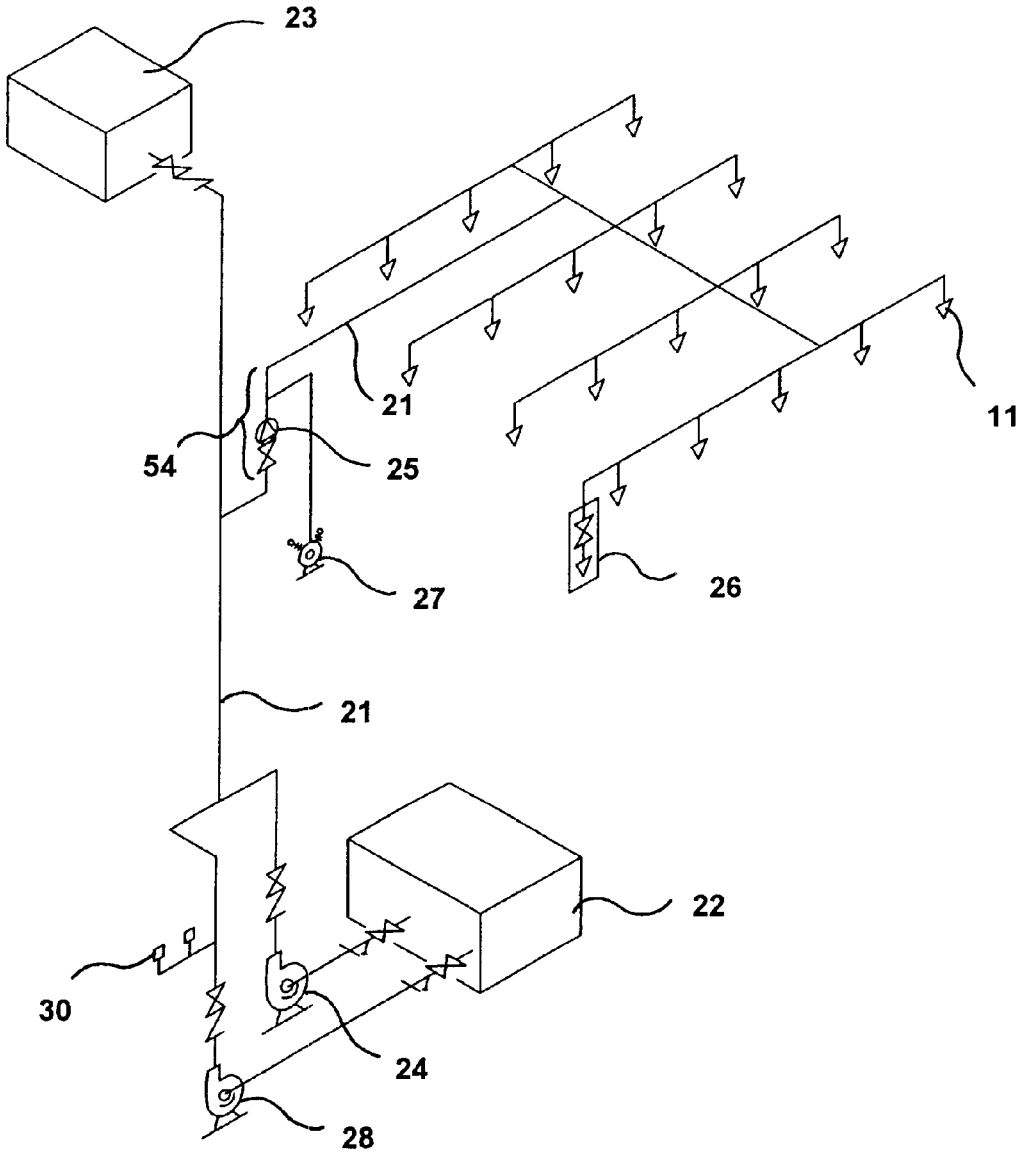
FIG. 4 is an outlined diagram to show an exemplification of dry pipe sprinkler system.
Figure 5:
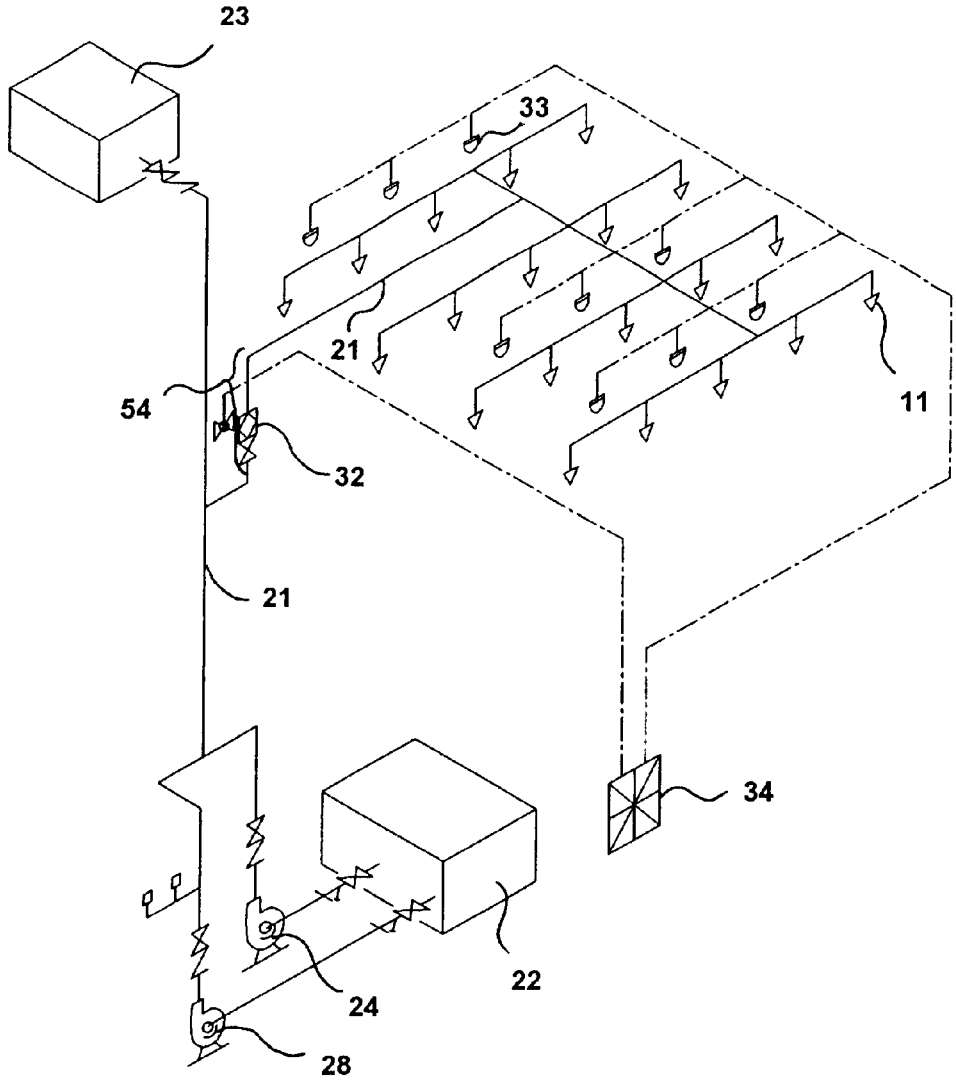
FIG. 5 is an outlined diagram to show an exemplification of preaction sprinkler system.

In general, a fusible heat-actuated element(17) as shown in FIG. 1, is composed of an orifice-sealing disc(18) of round type that may be a metal or a plastic-coated metal, a disc-supporting metal(19) of round-plate type and a few of metallic components holding a fusible metal, and on the other hand, a frangible heat-actuated element, not shown in drawings, is composed of an orifice-sealing disc with a hole in its center that may be a metal or a plastic-coated metal, a disc-supporting metal to be shaped a little similarly to a bolt with no thread and a glass bulb to be frangible by heat.

Figure 6:
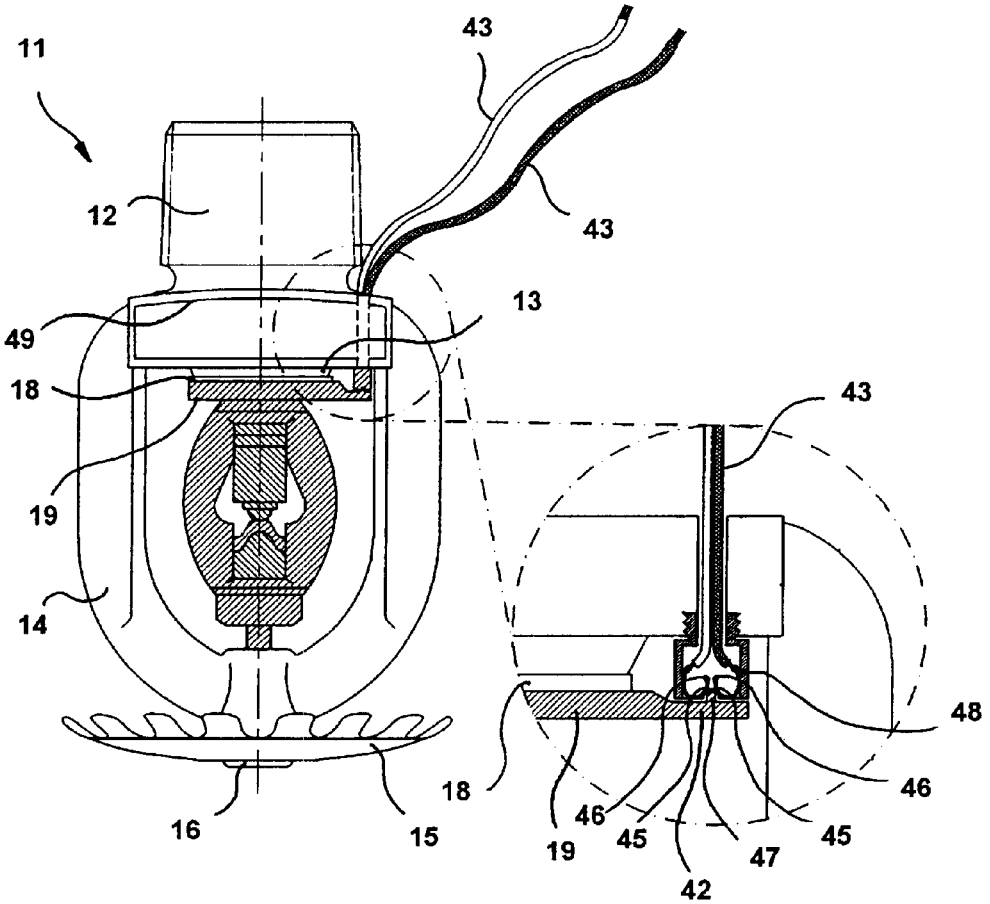
FIG. 6 is an outlined diagram of an automatic sprinkler of fire detector type exemplified in accordance with the present invention, showing that a modularized electric switch to be normally open is joined to the metallic framed-body of the automatic sprinkler.
Figure 7:
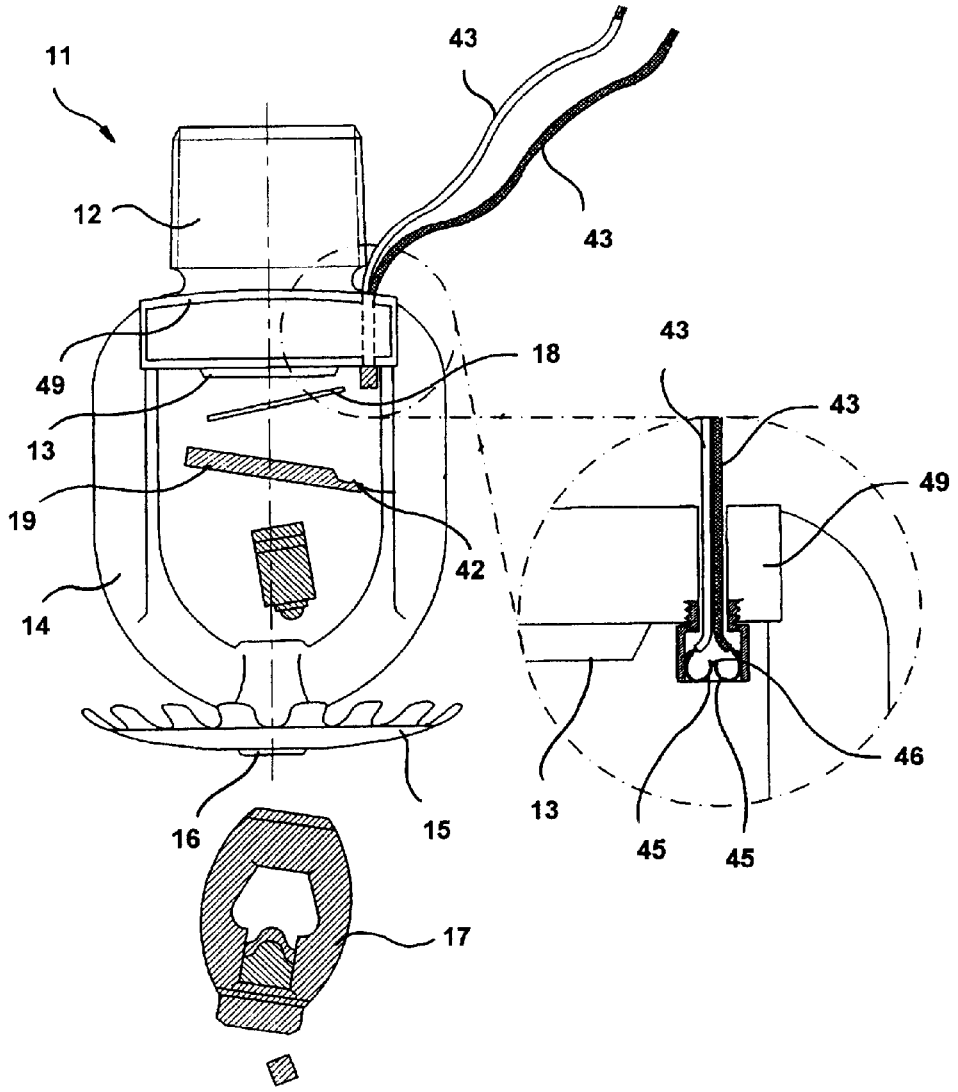
FIG. 7 is a diagram showing that the modularized electric open-switch joined with the automatic sprinkler in FIG. 6 is closed due to the separation of heat-actuated element by which the automatic sprinkler is opened.

An electric switch to be normally open as described above may come into configuration by attaching a modularized electric micro-switch(48) to be specially made, shown in a dotted-circle in FIG. 6, to a brim(49) of the metallic framed-body(12). The above micro-switch(48) may consists of two springs(45) each of which has a contact point(46) and is connected to an insulated electric wire(43). And, the two springs(45) are always pushed up by a small projected spot(47) on a brim(42) of disc-supporting metal(19) so that the two contact points(46) can be normally apart from each other in non-fire situation. However, as shown in FIG. 7, when the heat-actuated element(17) is separated from the sprinkler(11) by heat, the two springs(45) can come into contact since the pushing force to the springs(45) is lost. In this case, it may be desirable that the disc-supporting metal (19) is slightly modified so as to have an extended brim(42) with a projected spot(47). Other numerics of 13, 14, 15, 16 and 18 are the same as those of FIG. 1 as described above.

The operation principle of such a micro-switch(48) exemplified above is not different from many kinds of micro-switches to be commercially used, and so it may be not unfamiliar to those who have skills in the art.

An electric switch to be normally open may be configured, not shown in figure, so that the metallic ends in one side of a couple of insulated electric wires may face each other between the brim of sprinkler body and the disc-supporting metal, and by such a configuration, discharged water can become an electrically contacting medium between the above metallic ends. However, the automatic sprinkler of fire detector type with such a switchable function may have a limited applicability in the sprinkler systems other than wet pipe sprinkler system.

Figure 8:
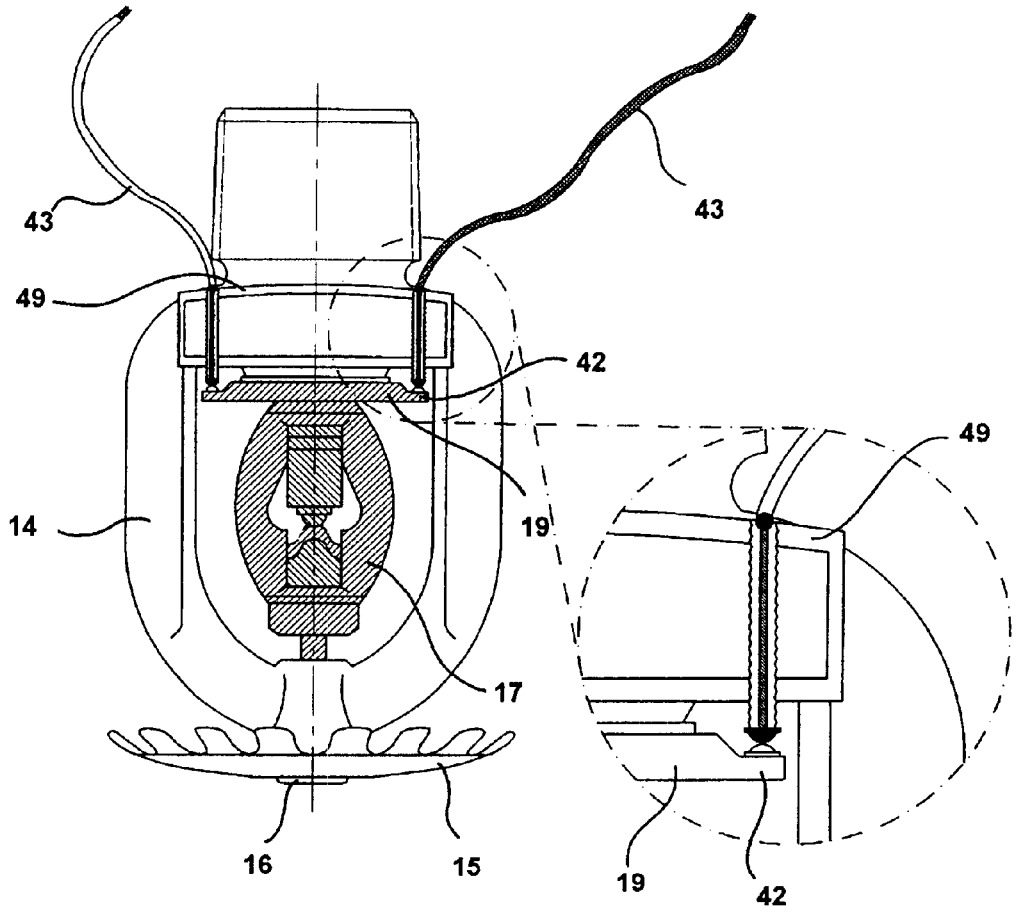
FIG. 8 is another outlined diagram of automatic sprinkler of fire detector type exemplified in accordance with the present invention, showing that the heat-actuated element is configured so as to become an electric closed-switch as well as a heat-actuator.
Figure 9:
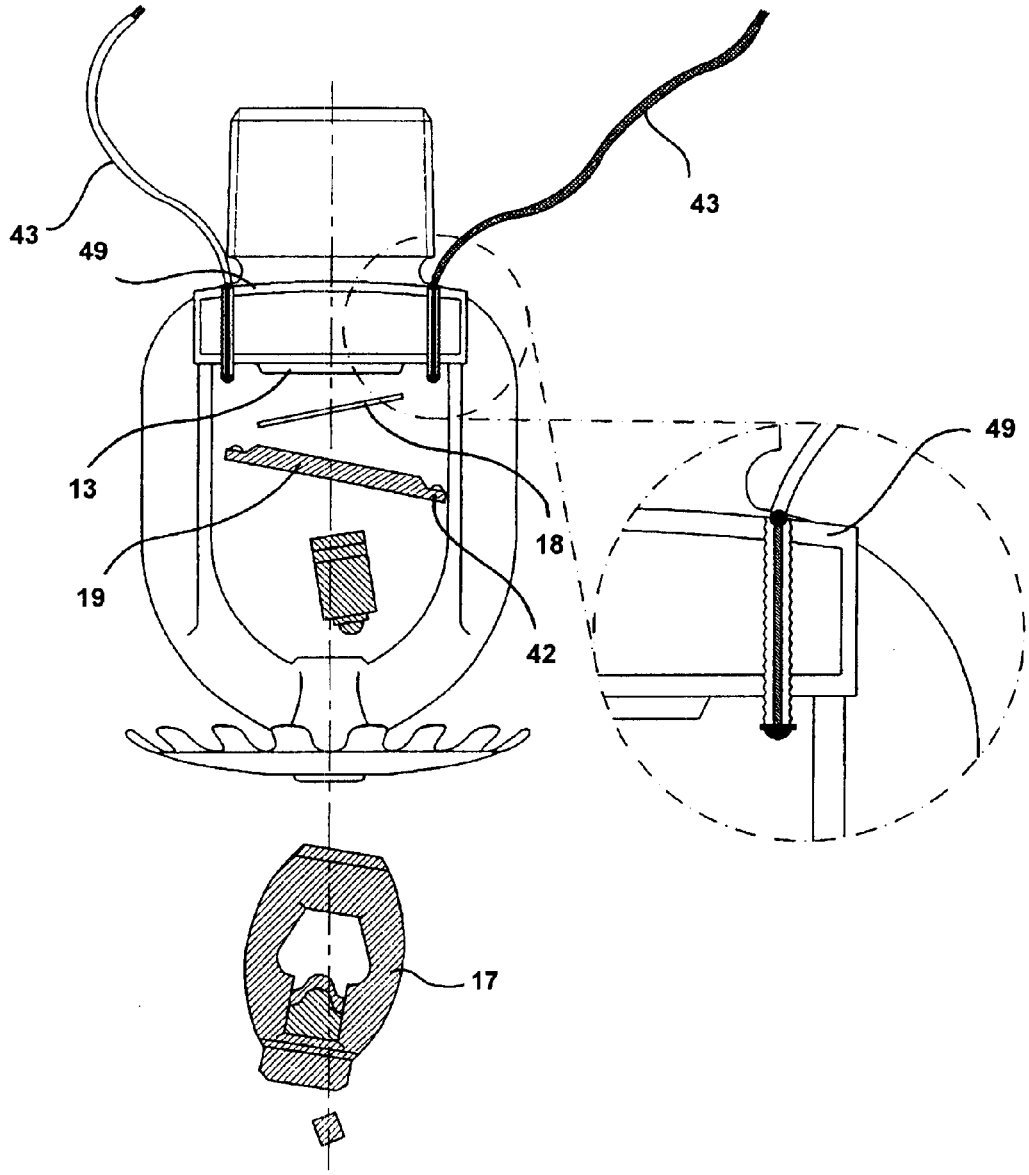
FIG. 9 is a diagram showing that the electric closed-switch is opened due to the separation of heat-actuated element by which the sprinkler is opened.
Figure 10:
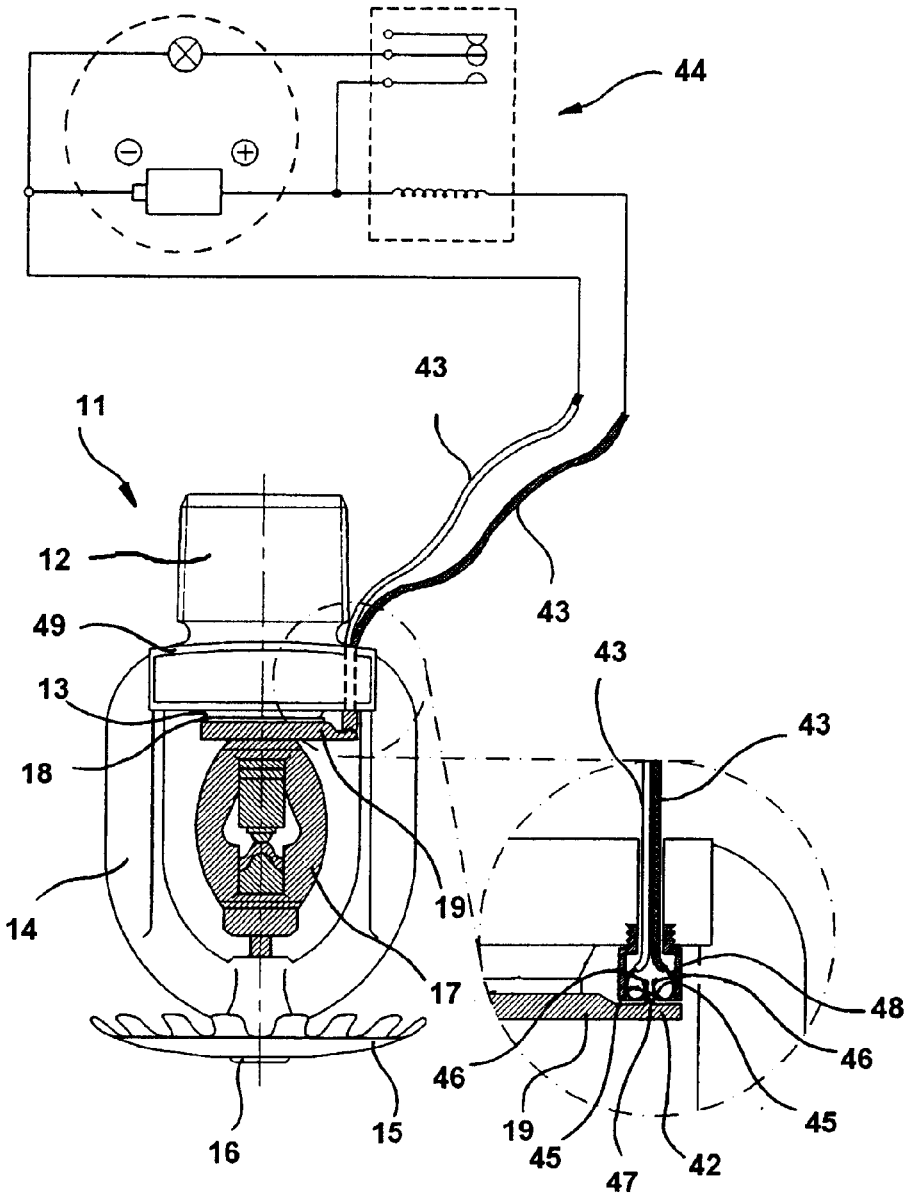
FIG. 10 is an outlined diagram exemplified in accordance with the present invention, showing that the electric open-switch in FIG. 6 is connected to the electric circuits shown in a dotted-rectangle and a dotted-circle while the electric circuit includes a fire indicating device circuit.
Figure 11:
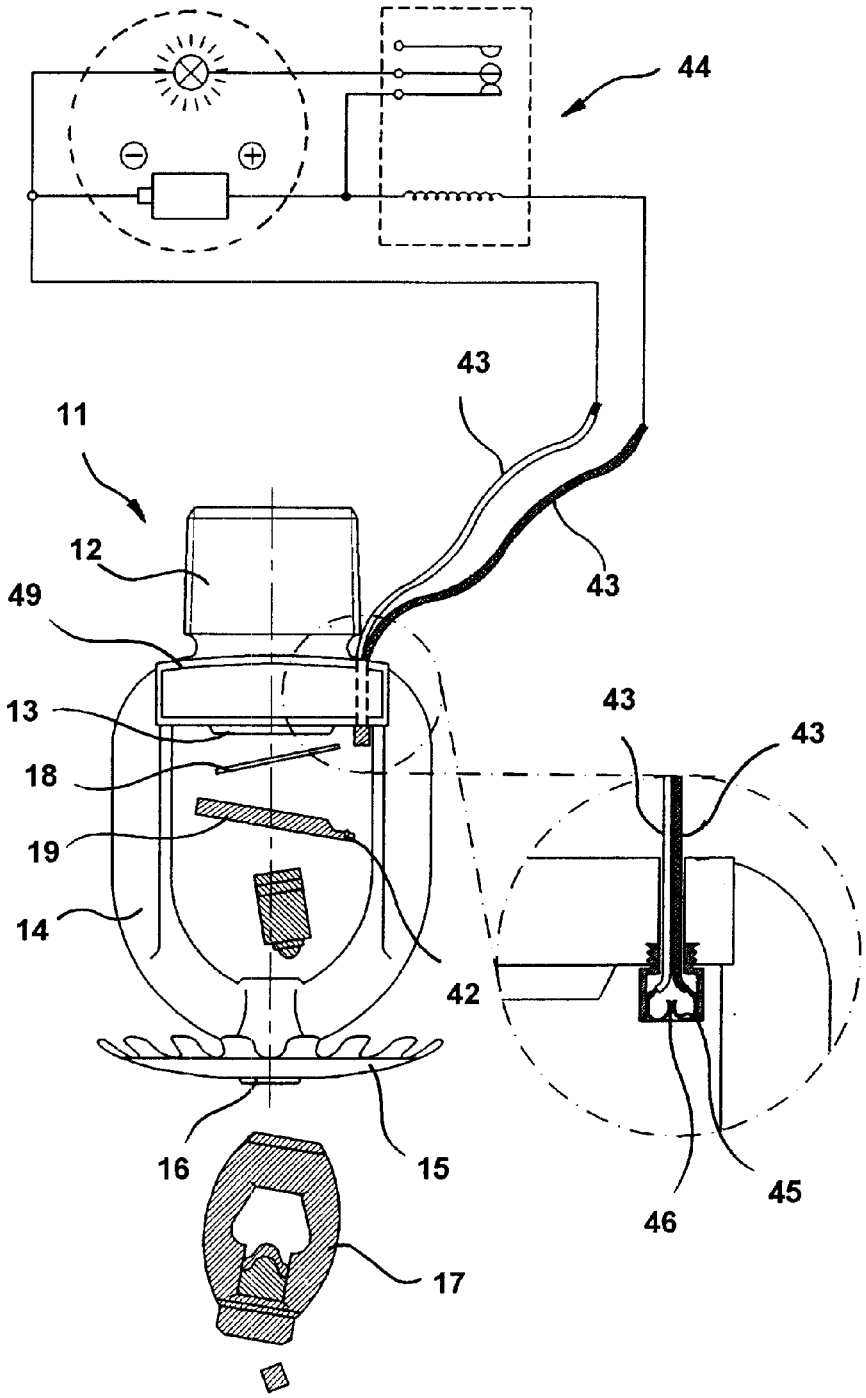
FIG. 11 is a diagram showing that the fire indicating device circuit to be open as shown in FIG. 10 is closed and at the same time an indicating device, i.e., a lamp is turned on by actuation of the modularized electric switch that occurs when the heat-actuated element is separated from the automatic sprinkler.
Figure 12:
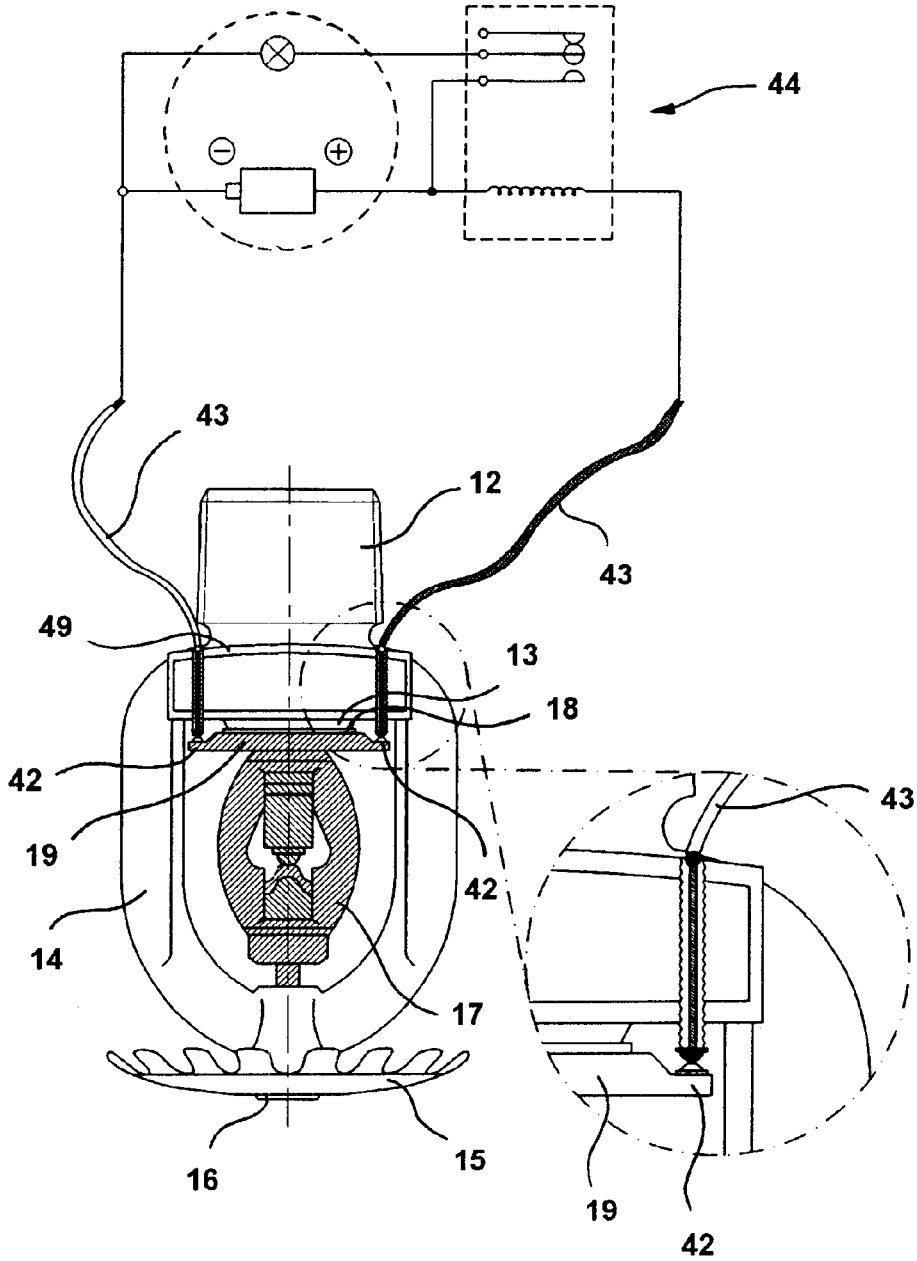
FIG. 12 is an outlined diagram exemplified in accordance with the present invention, showing that the electric closed-switch shown in FIG. 8 is connected to the electric circuits in a dotted-rectangle and a dotted-circle while the electric circuit in the dotted-circle includes a fire indicating device.
Figure 13:
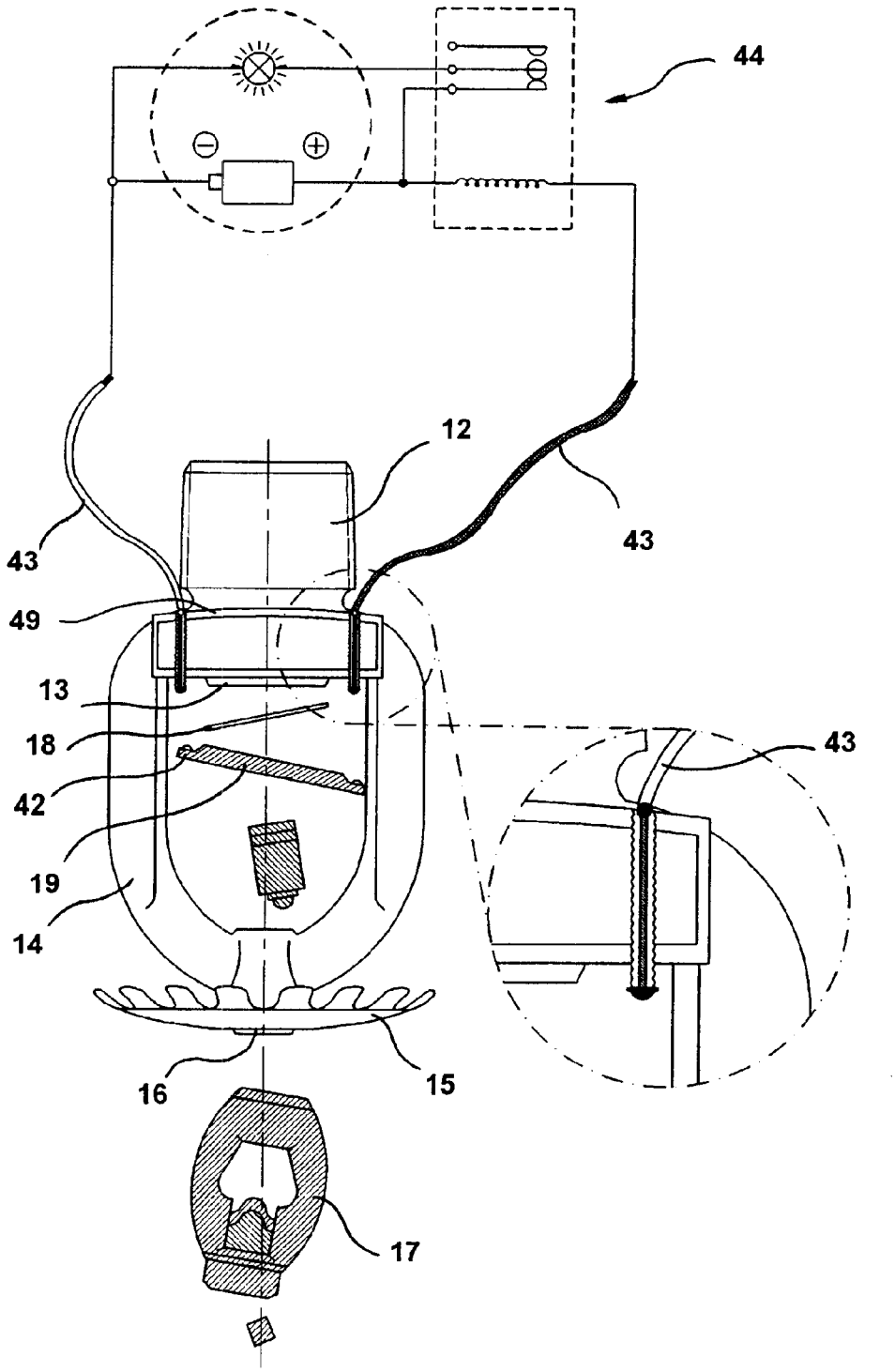
FIG. 13 is a diagram showing that the fire indicating device circuit to be open as shown in FIG. 12 is closed and at the same time an indicating device, i.e., a lamp is turned on by actuation of the electric switch that occurs when the heat-actuated element is separated from the sprinkler.

Now, an electric switch to be normally closed as previously mentioned, may also come into configuration, as shown in FIG. 8, by making a metallic component of heat-actuated element(17), preferably the disc-supporting metal(19), to be normally in contact with a couple of insulated electric wires(43), and by such a configuration, the disc-supporting metal(19) can become an electric bridge between the electric wires(43). In this case, it may be desirable to use a disc-supporting metal(19) with slightly extended brim(42) instead of the existing disc-supporting metal(19). The electric bridge may be disconnected as shown in FIG. 9, when the heat-actuated element(17) is separated from the sprinkler(11) by heat.

It should be noted that all metallic substances included in the automatic sprinkler(11) as described above, except the plastic-coated orifice-sealing disc, are electrically conductible. However, when an electric switch to be normally closed that is included in automatic sprinkler(11) of fire detector type is associated with an electrically energized line-circuit (44), an electric current may always flow through the line-circuit, as shown in FIG. 10 to FIG. 13, however, actual consumption of electric energy is practically not significant because the line-circuit is usually energized by both a rated voltage lower than 30 volts and a weak DC current of several milli-amperes at most.

The sprinkler system provided by the present invention may be configured so that protective signaling and controlling system including fire indicating appliance circuits, fire alarm initiating device circuits, signaling line circuits, operating equipment or device circuits and other necessary circuits, can be activated by actuation, i.e., electrically switching, of automatic sprinkler of fire detector type in accordance with the present invention, and hence the above sprinkler system can be essentially characterized.

The above sprinkler system may be designed so that it may take one or both of two ways for addressable detection of a fire; one is sprinkler-addressable detection that means to detect every sprinkler that opens, and the other is area-addressable detection that means to detect every freely established area to be sprinklered where sprinkler opens.

Figure 14:
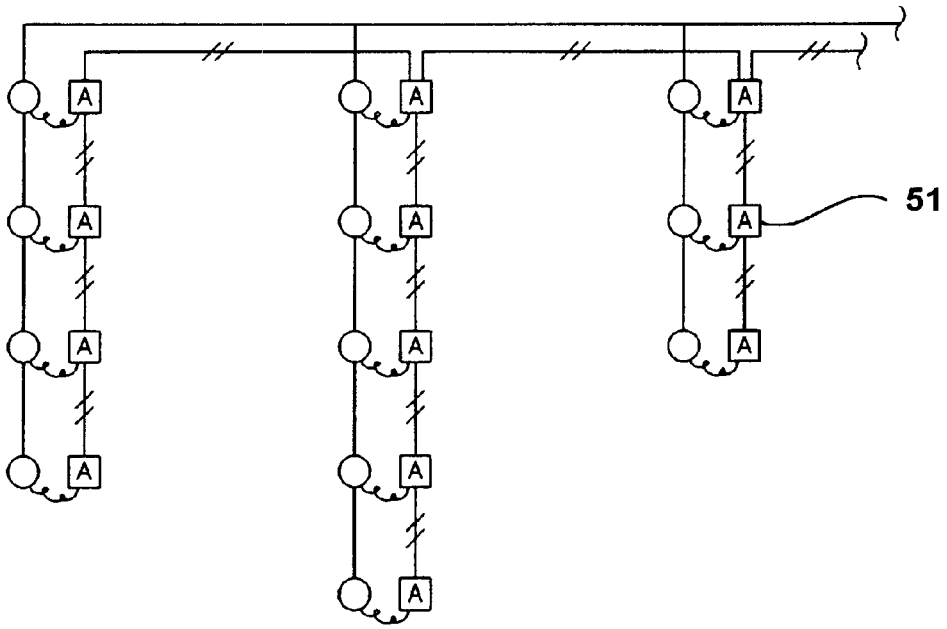
FIG. 14 is an outlined electric line-circuit diagram for sprinkler-addressable detection exemplified in accordance with the present invention, showing that electric modules to be addressably multi-transmittable are employed in the line-circuit by module-to-module connection while those are matched with every automatic sprinkler of fire detector type by one-to-one connection.
Figure 15:
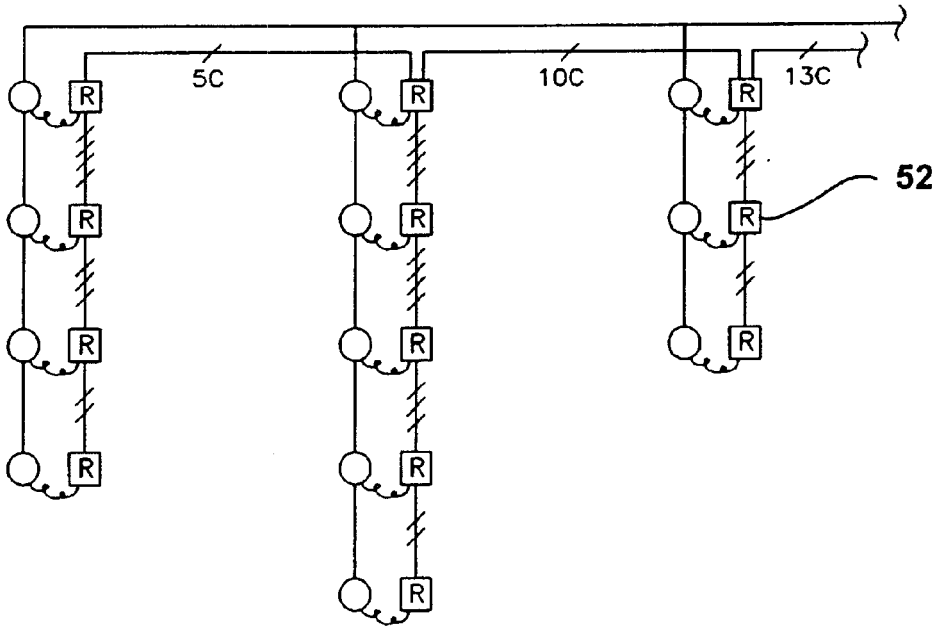
FIG. 15 is another outlined electric line-circuit diagram for sprinkler-addressable detection exemplified in accordance with the present invention, showing that conventional electric relay-modules are employed in the line-circuit by module-to-module connection while those are matched with every automatic sprinkler of fire detector type by one-to-one connection.

It may become a possible configuration of initiating circuit for sprinkler-addressable detection of a fire that electric modules to be addressably multi-transmittable(51) or conventional electric relay-modules(52) are employed, shown in FIG. 14 and FIG. 15, in an electric line-circuit by module-to-module connection while those are matched with every automatic sprinkler of fire detector type(41) by one-to-one connection, as shown in the figures. In this case, the conventional electric relay-modules(52) may be installed in or out the sprinklered area, or may be integrated within a control unit that may be used for local or central control.

Figure 16:
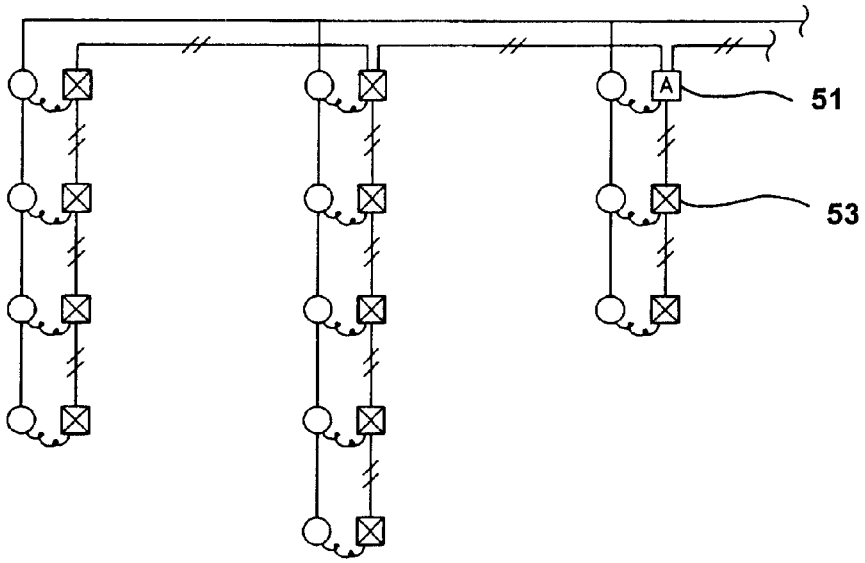
FIG. 16 is an outlined electric line-circuit diagram for area-addressable detection exemplified in accordance with the present invention, showing that an electric module to be addressably multi-transmittable is employed in the line-circuit while every automatic sprinkler of fire detector type in the sprinklered area shown in the figure is connected to the line-circuit.
Figure 17:
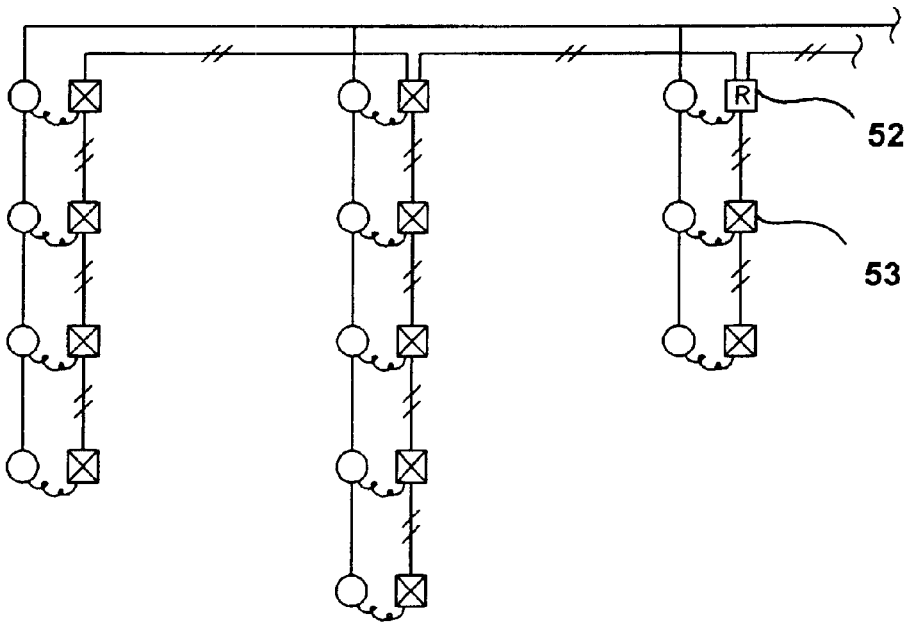
FIG. 17 is an outlined electric line-circuit diagram for area-addressable detection exemplified in accordance with the present invention, showing that a conventional electric relay-module is employed in the line-circuit while every automatic sprinkler of fire detector type in the sprinklered area shown in the figure is connected to the line-circuit.

It may become a possible configuration of initiating circuit for area-addressable detection of a fire that an electric module to be addressably multi-transmittable(51) or a conventional electric relay-module(52) is employed, shown in FIG. 16 and FIG. 17, in an electric line-circuit while every automatic sprinkler of fire detector type(41) in a sprinklered area is connected to the line-circuit, as shown in the figures.

It is important to note that the above electric module, addressably multi-transmittable type(51) or conventional relay-type(52), is quite familiar to those who have skills in the art because it is now commercially produced and frequently utilized in electric systems to be associated with fire protection systems in many countries in the world. For instance, both an addressably multi-transmittable module with a brand name of P501-94002 Hi-Mux Repeater and a control unit with a brand name of RYMO-1 Receiver to be adaptive to the above Hi-Mux Repeater are commercially produced by Dongbang Electronic Industrial Co., Ltd. in the Republic of Korea, however, the multi-transmittable module and the adaptable control unit to be associated with the present invention are not limited to the above products.

And, the number of slashes on the connecting lines between the electric modules in FIG. 14 and FIG. 15 or between junction boxes(53) in FIG. 16 and FIG. 17 represent the number of electric lines, and the number included in the indication such as 15C, 10C and 13C in FIG. 15 mean the number of electric cores included in an electric wire. The above slashes and indications are so familiar to those who have skills in the art.

By the present invention, more various functions and more convenient care and maintenance than the existing sprinkler systems can be achieved since the necessary electric controls for fire detection, fire alarming and indication, and operation of fire pump, etc. can be accomplished by opening of sprinkler by a fire without any waterflow detecting device, supplemental fire detection system or dry pipe valve. Particularly, by the present invention, it is possible to configure more simplified wet pipe sprinkler system than the existing one because the waterflow detecting device.(31) such as alarm check valve and the test-connection(26) for routine test of the waterflow detecting device are not necessitated. Moreover, it is possible to replace the existing preaction or dry pipe sprinkler system for protection of unheated area with a simple non-wet pipe sprinkler system that employs deluge valve to be activated by opening of sprinkler without any supplemental fire detection system or dry pipe valve(25).

Besides, by the present invention, it is also possible that fire pump operates automatically without any means such as pressure maintenance pump(28) and pressure switches(30) because the fire pump can reliably operates in compliance with opening of automatic sprinkler of fire detector type without utilizing a rise or drop in water pressure within system pipings(21).

The above descriptions are till now referred to the automatic sprinkler of fire detector type that heat-actuated element seals directly a water discharge orifice, however, the same mechanism as described above to configure an electric switch may be applied to structure of the existing automatic sprinkler, which is often used for flush-mounting on ceiling, that a water discharge orifice is normally sealed by a framed deflector pressed toward the orifice by heat-actuated element and opened when the deflector drops down off the orifice due to separation of the heat-actuated element by heat from a fire, and so such a configuration can be easily understood to those who have skills in the art.

While the present invention has been described and illustrated herein with reference to the certain preferred embodiment thereof, it will be also no problem to those who have skills in the art to understand and recognize that a great number of configurations and enhancements by modification or transformation are possible according to the philosophy and scope of the present invention, and therefore, it will be natural that such modification or transformation can be also included in claims in accordance with the present invention.

What I claimed is:

1. An automatic sprinkler of fire detector type having an electric switch fixed to a base of the sprinkler in such a manner that:

an electric contact of the electrical switch, being electrically insulated from the base of the sprinkler, is normally held in one of an ON and an OFF position by a force pushing the electric contact, the pushing force extending from contact between the electric switch and a part of a heat actuated element of the sprinkler; and an automatic sprinkler system comprising the automatic sprinkler of fire detector type is characterized in that the sprinkler system has a configuration by which operation of a protective signaling and controlling system including fire indicating appliance circuits and operating equipment or device circuits can be initiated by opening of the automatic sprinkler.

2. A sprinkler system comprising the automatic sprinkler of fire detector type of claim 1, characterized in that the configuration of non-wet pipe system available for protection of unheated sprinklered occupancy or structure can be provided by the above sprinkler system.

3. The automatic sprinkler of fire detector type of claim 1, characterized in that the function of electric switch can be provided by an electric switch made by assembly in the automatic sprinkler or a pre-modularized electric switch joined to the automatic sprinkler so as to activate in accordance with separation of the heat-actuated element.

4. The automatic sprinkler of fire detector type of claim 1, characterized in that the function of electric switch can be provided by the heat-actuated element configured so as to become an electric bridge between a couple of positive and negative poles that may be electrically energized.

5. The automatic sprinkler of fire detector type of claim 1, characterized in that the function of electric switch can be provided by a configuration by which water discharged from the water discharge orifice in accordance with separation of the heat-actuated element can become an electric bridge that allows an electric current to flow between a couple of positive and negative poles to be electrically energized that are normally apart from each other.

6. The automatic sprinkler of fire detector type of claim 1, characterized in that the automatic sprinkler is configured so as to have two electric wires or terminals for connection with an electric circuit that may need the function of electric switch included in the automatic sprinkler.

7. A sprinkler system comprising the automatic sprinkler of fire detector type of claim 1, characterized in that the above sprinkler system has a configuration by which operation of protective signaling and controlling system including fire indicating appliance circuits and operating equipment or device circuits can be initiated by opening of the automatic sprinkler.

8. A sprinkler system comprising the automatic sprinkler of fire detector type of claim 1, characterized in that the above sprinkler system can operate one or more fire pumps without utilizing a rise or drop in water pressure within system pipings.

9. A sprinkler system comprising the automatic sprinkler of fire detector type of claim 1, characterized in that the configuration of wet pipe sprinkler system to be fire-detectable without waterflow detecting device can be provided by the above sprinkler system.

10. An automatic sprinkler of fire detector type having a base and an electric switching mechanism comprising:

two electric contacts electrically insulated from the base of the sprinkler and normally positioned apart from but close to a heat actuated element of the sprinkler; and a water column formed by water discharged out of an orifice of the sprinklers;

wherein the two electric contacts come into contact with the water column formed by water discharged out of the orifice, the orifice is opened due to detachment of the heat actuated element, and the water column functions as an electrical bridge to permit flow of an electric current between the two electric contacts to be electrically energized.

11. A sprinkler wet-pipe system having the automatic sprinkler of the fire detector type of claim 10, characterized in that the sprinkler wet-pipe system operates such that every fire occurring in one or more zones of an area protected by the sprinkler wet-pipe system is monitored by an indicating appliance circuit associated with at least one automatic sprinkler installed in every zone.

12. A sprinkler system comprising the automatic sprinkler of fire detector type of claim 10, characterized in that the configuration of non-wet pipe system available for protection of unheated sprinklered occupancy or structure can be provided by the above sprinkler system.

13. The automatic sprinkler of fire detector type of claim 10, characterized in that the function of electric switch can be provided by an electric switch made by assembly in the automatic sprinkler or a pre-modularized electric switch joined to the automatic sprinkler so as to activate in accordance with separation of the heat-actuated element.

14. The automatic sprinkler of fire detector type of claim 10, characterized in that the function of electric switch can be provided by the heat-actuated element configured so as to become an electric bridge between a couple of positive and negative poles that may be electrically energized.

15. The automatic sprinkler of fire detector type of claim 10, characterized in that the function of electric switch can be provided by a configuration by which water discharged from the water discharge orifice in accordance with separation of the heat-actuated element can become an electric bridge that allows an electric current to flow between a couple of positive and negative poles to be electrically energized that are normally apart from each other.

16. The automatic sprinkler of fire detector type of claim 10, characterized in that the automatic sprinkler is configured so as to have two electric wires or terminals for connection with an electric circuit that may need the function of electric switch included in the automatic sprinkler.

17. A sprinkler system comprising the automatic sprinkler of fire detector type of claim 10, characterized in that operation of protective signaling and controlling system including fire indicating appliance circuits and operating equipment or device circuits is initiated by electrical switching of the automatic sprinkler.

18. A sprinkler system comprising the automatic sprinkler of fire detector type of claim 10, characterized in that the above sprinkler system can operate one or more fire pumps without utilizing a rise or drop in water pressure within system pipings.

19. A sprinkler system comprising the automatic sprinkler of fire detector type of claim 10, characterized in that the above sprinkler system can employ fire pump to be driven by speed-changeable motor controlled by a computer to be hydraulically pre-programmed so as to supply fire water adjusted quantitatively in accordance with the number of opened sprinklers.

20. A sprinkler system comprising the automatic sprinkler of fire detector type of claim 10, characterized in that the configuration of wet pipe sprinkler system to be fire-detectable without waterflow detecting device can be provided by the above sprinkler system.

21. An automatic sprinkler of fire detector type having an electric switch fixed to a base of the sprinkler in such a manner that:

an electric contact of the electrical switch, being electrically insulated from the base of the sprinkler, is normally held in one of an ON and an OFF position by a force pushing the electric contact, the pushing force extending from contact between the electric switch and a part of a heat actuated element of the sprinkler; and a sprinkler system comprising the automatic sprinkler of fire detector type is characterized in that the above sprinkler system can employ fire pump to be driven by speed-changeable motor controlled by a computer to be hydraulically pre-programmed so as to supply fire water adjusted quantitatively in accordance with the number of opened sprinklers.

22. An automatic sprinkler of fire detector type having an electric switch fixed to a base of the sprinkler in such a manner that:

an electric contact of the electrical switch, being electrically insulated from the base of the sprinkler, is normally held in one of an ON and an OFF position by a force pushing the electric contact, the pushing force extending from contact between the electric switch and a part of a heat actuated element of the sprinkler; and a sprinkler wet-pipe system having the automatic sprinkler of fire detector type is characterized in that the sprinkler wet-pipe system operates such that every fire occurring in one or more zones of an area protected by the sprinkler wet-pipe system is monitored by an indicating appliance circuit associated with at least one automatic sprinkler installed in every zone.

* * * * *